United States Patent [19]

Clem et al.

[11] 4,125,454

[45] Nov. 14, 1978

[54] PROCESS FOR SUPPRESSION OF CATALYST DEACTIVATION AND $C_5$+ LIQUID YIELD LOSS IN A CYCLIC REFORMING UNIT

[75] Inventors: Kenneth R. Clem; George A. Swan, both of Baton Rouge, La.; Louis Dauber, Cranford, N.J.

[73] Assignee: Exxon Research & Engineering Co., Linden, N.J.

[21] Appl. No.: 851,060

[22] Filed: Nov. 14, 1977

[51] Int. Cl.[2] ..... C10G 35/08

[52] U.S. Cl. ..... 208/65; 208/63

[58] Field of Search ..... 208/63, 65

[56] References Cited

U.S. PATENT DOCUMENTS

| | | | |
|---|---|---|---|
| 2,944,008 | 7/1960 | Haxton et al. | 208/65 |
| 3,000,809 | 9/1961 | Ridgeway et al. | 208/65 |
| 3,117,073 | 1/1964 | Hertwig et al. | 208/65 |

*Primary Examiner*—C. Davis

*Attorney, Agent, or Firm*—L. A. Proctor

[57] ABSTRACT

A process for reforming with hydrogen, or hydroforming, a naphtha in a cyclic reforming unit which contains a plurality of catalyst-containing on stream reactors in series, and a catalyst-containing swing reactor manifolded therewith which can be periodically placed in series and substituted for an on stream reactor while the latter is removed from series for regeneration and reactivation of the catalyst contained therein. In the process, a reactor which is next scheduled for regeneration and reactivation of its near deactivated catalyst is located immediately downstream next in series with a reactor which contains freshly regenerated, reactivated catalyst at the time the latter is initially put on stream so that sulfur released by the freshly regenerated, reactivated catalyst which occurs a short time after the upstream reactor has been returned to service, is adsorbed by the near deactivated catalyst of the reactor next requiring removal from the series for catalyst regeneration and reactivation. Subsequent to this time, and prior to any desorption and release of major concentrations of sulfur from the deactivated catalyst, the reactor used for scavenging the sulfur is then swung out of series for regeneration and reactivation of the sulfided catalyst, and replaced in the series by the swing reactor.

9 Claims, 2 Drawing Figures

PROCESS FOR SUPPRESSION OF CATALYST DEACTIVATION AND $C_5+$ LIQUID YIELD LOSS IN A CYCLIC REFORMING UNIT

Reforming with hydrogen, or hydroforming, is a well established industrial process employed by the petroleum industry for upgrading virgin or cracked naphthas for the production of high octane products. Noble metal, notably palladium and platinum type catalysts are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins to produce gas and coke, the latter being deposited on the catalyst.

These several reactions are both endothermic and exothermic, the former predominating, particularly in the early stages of reforming with the latter predominating in the latter stages of reforming. In view thereof, it has become the practice to employ a plurality of adiabatic fixed-bed reactors in series with provision for interstage heating of the feed to each of the several reactors. Two major types of reforming are generally practiced in the multireactor units, and in all processes the catalyst must be periodically regenerated by burning off the coke in the initial part of the catalyst reactivation sequence; since coke deposition gradually deactivates the catalyst. In a semi-regenerative process, a process of the first step, the entire unit is operated by gradually and progressively increasing the temperature to maintain the activity of the catalyst caused by the coke deposition, until finally the entire unit is shut down for regeneration, and reactivation, of the catalyst. In the second, or cyclic type of process, the reactors are individually isolated, or in effect swung out of line by various piping arrangements, the catalyst is regenerated to remove the coke deposits, and then reactivated while the other reactors of the series remain on stream. A "swing reactor" temporarily replaces a reactor which is removed from the series for regeneration and reactivation of the catalyst, and is then put back in series. In such processes hydrogen is produced in net yield, the product being separated into a $C_5+$ liquid product, e.g., a $C_5$/430° F. product, and a hydrogen rich gas a portion of which is recycled to the several reactors of the process unit.

In a cyclic reforming unit, individual reactors of the multi-reactor unit can be isolated, the catalyst regenerated, and reactivated, and the reactor placed back on stream without significantly affecting unit feed rate or octane quality. By adjusting the regeneration frequency, the unit can be economically designed for the minimum loading of hydrogenation-dehydrogenation metal, or metals components on the catalyst while maintaining an optimum yield of $C_5+$ reformate at given conditions.

Essentially all petroleum naphtha feeds contain sulfur, a well known catalyst poison which can gradually accumulate upon and poison the catalyst. Most of the sulfur, because of this adverse effect, is generally removed from feed naphthas, e.g., by contact with nickel or cobalt oxide guard chambers. In use of the more recently developed multi-metallic platinum catalysts wherein an additional metal, or metals hydrogenation-dehydrogenation component is added as a promoter to the platinum, it has become essential to reduce the feed sulfur to only a few parts, per million parts by weight of feed (ppm). For example, in the use of platinum-rhenium catalysts it is generally necessary to reduce the sulfur concentration of the feed well below about 10 ppm, and preferably well below about 2 ppm, to avoid excessive loss of catalyst activity and $C_5+$ liquid yield. The role of sulfur on the catalyst presents somewhat of an anomaly because the presence of sulfur in the feed can adversely affect the activity of the catalyst and reduce liquid yield; and yet, a sulfiding of the multi-metallic catalyst species, which is a part of the catalyst reactivation procedure, has been found essential to suppress excessive hydrogenolysis which is particularly manifest when a reactor is first put on stream after regeneration and reactivation of the catalyst. Excessive hydrogenolysis caused by use of these highly active catalysts can not only produce acute losses in $C_5+$ liquid yield through increased gas production, but the severe exotherms which accompany operation in a hydrogenolysis mode can seriously damage the catalyst, reactor, and auxiliary equipment.

In cyclic reforming, it has been found that when a reactor containing highly active rhenium promoted platinum catalysts is reinserted in the multiple reactor series of the unit, albeit it contains regenerated, reactivated, sulfided catalyst, there occurs an initial upset period when the catalyst activity and $C_5+$ liquid yield of the unit is reduced. It has been observed that this effect is first noted in the reactor immediately downstream of the swing reactor, and progresses in seratim from one reactor of the series to the next until the $C_5+$ liquid yield loss is observed throughout the unit. Over a sufficiently long period after the initial decline in $C_5+$ liquid yield loss, the $C_5+$ liquid yield in the several reactors of the unit, and consequently the overall performance of the unit, gradually improves, though often the improvement is not sufficient to return each of the reactors of the unit, or unit as a whole, to its original higher performance level.

The effect of this phenomenon is that, in the overall operation, the catalyst contained in the several reactors briefly becomes less active, and a transient, but profound $C_5+$ liquid yield loss is observed.

It is, accordingly, the primary object of this invention to provide a new and improved process which will obviate these and other disadvantages of the present start-up procedures for cyclic reforming units, particularly those employing highly active promoted noble metal containing catalysts.

A specific object is to provide a new and novel operating procedure for cyclic reforming units, notably one which will suppress the normally expected initial period of $C_5+$ liquid yield decline which occurs with palladium and platinum catalysts to which is added a hydrogenation-dehydrogenation component, or components, particularly rhenium, which increases the tendency of the catalyst to operate in the hydrogenolysis mode.

These objects and others are achieved in accordance with the present invention which comprises a new and improved mode of operating a cyclic reforming unit wherein in the sequence of regeneration and reactivation of the catalyst of any given reactor, a reactor which is next scheduled for regeneration and reactivation of its near deactivated catalyst is that reactor immediately downstream and next in series with the reactor which contains freshly regenerated and reactivated catalyst, so that sulfur released by this freshly regenerated, reactivated catalyst which occurs a short time after it has been returned to service, is adsorbed by the near deactivated catalyst of the downstream reactor next requiring removal from the series for catalyst regeneration and reactivation. Subsequent to this time, and prior to any desorption and release of major concentrations of sulfur from the near deactivated catalyst, the reactor used for scavenging the sulfur is then swung out of series for regeneration, and reactivation of the sulfur containing catalyst, and replaced in the series by the swing reactor.

The present invention has resulted from the observations that a reactor which contains a freshly regenerated, reactivated catalyst when returned to service rapidly releases sulfur and that, unlike a freshly regenerated, reactivated catalyst, a near deactivated catalyst which contains a considerable amount of coke will adsorb sulfur, with subsequently much slower desorption than freshly regenerated catalyst. It was thus observed that when a reactor containing a regenerated, reactivated, presulfided catalyst was returned to service there occurred a rapid sulfur release, a pulse of hydrogen sulfide being manifested in the immediate downstream reactor and sequentially in the following reactors of the series. Simultaneously with the pulses of sulfur to the reactors, rapid declines of $C_5^+$ liquid yields were observed, recovery of satisfactorily high $C_5^+$ liquid yields being attained all too slowly. Observing that there was a finite period over which a deactivated catalyst could adsorb sulfur prior to its desorption, these factors were utilized by selecting the reactor immediately downstream of a freshly regenerated, reactivated reactor for the next regeneration and reactivation. On return to service, the wave of sulfur released from the reactor containing the freshly regenerated, reactivated catalyst is adsorbed by the deactivated catalyst of the downstream, or scavenger reactor and thereafter, prior to any desorption and release of major concentrations of the sulfur by the deactivated catalyst, the scavenger reactor itself is removed from service for regeneration and reactivation of the catalyst and replaced in the series by the swing reactor. Thus the emittant source of a sulfur catalyst poison is isolated and the poison removed from the unit, this resulting in overall improved catalyst activity and selectivity maintenance.

A feature of the invention also resides in the discovery that there exists a substantially optimum time for removal of the scavenger reactor from the series, and its replacement by the swing reactor. Initially, it is found that when sulfur enters the scavenger reactor, the outlet temperature begins to approach the inlet temperature because catalyst sites are poisoned by the sulfur and catalyst activity is decreased. The initial response is quite rapid, and the corresponding rate of temperature change, i.e., $\Delta T$ or difference between the reactor outlet temperature and reactor inlet temperature, is quite rapid, reaching a minimum after which time desorption of the sulfur from the near deactivated catalyst begins. At substantially this point, in the preferred practice of this invention, the scavenger reactor is cut out of series and replaced by the swing reactor.

These features and others will be better understood by reference to the following more detailed description of the invention, and to the drawings to which reference is made.

Figure 1:
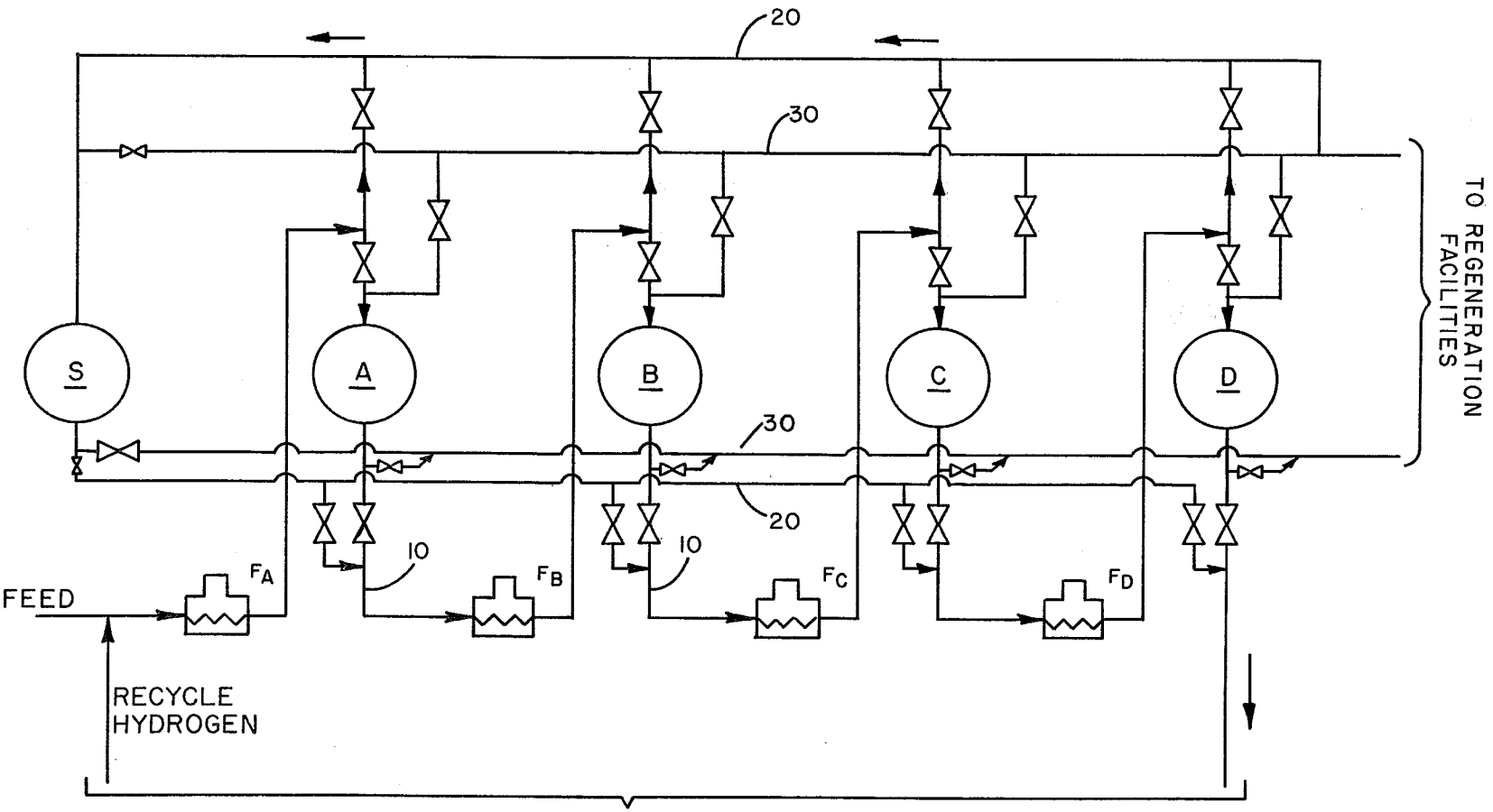
FIG. 1 depicts, by means of a simplified flow diagram, a preferred cyclic reforming unit inclusive of multiple on stream reactors, and an alternate or swing reactor inclusive of manifolds for use with catalyst regeneration and reactivation equipment (not shown).

Referring to FIG. 1, generally, there is described a cyclic unit comprised of a multi-reactor system, inclusive of on stream reactors A, B, C, D and a swing reactor S, and a manifold useful with a facility for periodic regeneration and reactivation of the catalyst of any given reactor, swing reactor S being manifolded to reactors A, B, C, D so that it can serve as a substitute reactor for purposes of regeneration and reactivation of the catalyst of a reactor taken off stream. The several reactors of the series A, B, C, D, are arranged so that while one is off stream for regeneration and reactivation of the catalyst, the swing reactor S can replace it and provision is also made for regeneration and reactivation of the swing reactor.

In particular, the on stream reactors A, B, C, D, each of which is provided with a separate furnace or heater $F_A$, or reheater $F_B$, $F_C$, $F_D$, respectively, are connected in series via an arrangement of connecting process piping and valves so that feed can be passed in seratim through $F_A$A, $F_B$B, $F_C$C, $F_D$D, respectively; or generally similar grouping wherein any of reactors A, B, C, D are replaced by reactor S. This arrangement of piping and valves is designated by the numeral 10, and is represented as a heavy black line. Any one of the on stream reactors A, B, C, D, respectively, can be substituted by swing reactor S as when any one of the former requires regeneration and reactivation of the catalyst. This is accomplished in "paralleling" the swing reactor with the reactor to be removed from the circuit for regeneration by opening the valves on each side of a given reactor which connect to the upper and lower lines of swing header 20, and then closing off the valves in line 10 on both sides of said reactor so that fluid enters and exits from said swing reactor S. Regeneration facilities, not shown, are manifolded to each of the several reactors A, B, C, D, S through a parallel circuit of connecting piping and valves which form the upper and lower lines of regeneration header 30, and any one of the several reactors can be individually isolated from the other reactors of the unit and the catalyst thereof regenerated and reactivated.

With continued reference to FIG. 1, it is assumed that the catalyst of reactor A has been regenerated and reactivated; that reactor A is off stream and that the flow of process fluids is through $F_A$S, $F_B$B, $F_C$C, $F_D$D. Regeneration and reactivation of the catalyst in reactor B is now scheduled. It is known that when feed, or oil, is contacted with the freshly reactivated catalyst of reactor A, sulfur will be desorbed, and a wave of sulfur will be passed downstream. Consequently, reactor B which is immediately downstream of reactor A is used to trap a large fraction of the sulfur released from reactor A prior to reactor B being removed for regeneration. Reactor S replaces reactor B in the series so that the flow of fluids is now through $F_A$A, $F_B$S, $F_C$C, $F_D$D.

Figure 2:
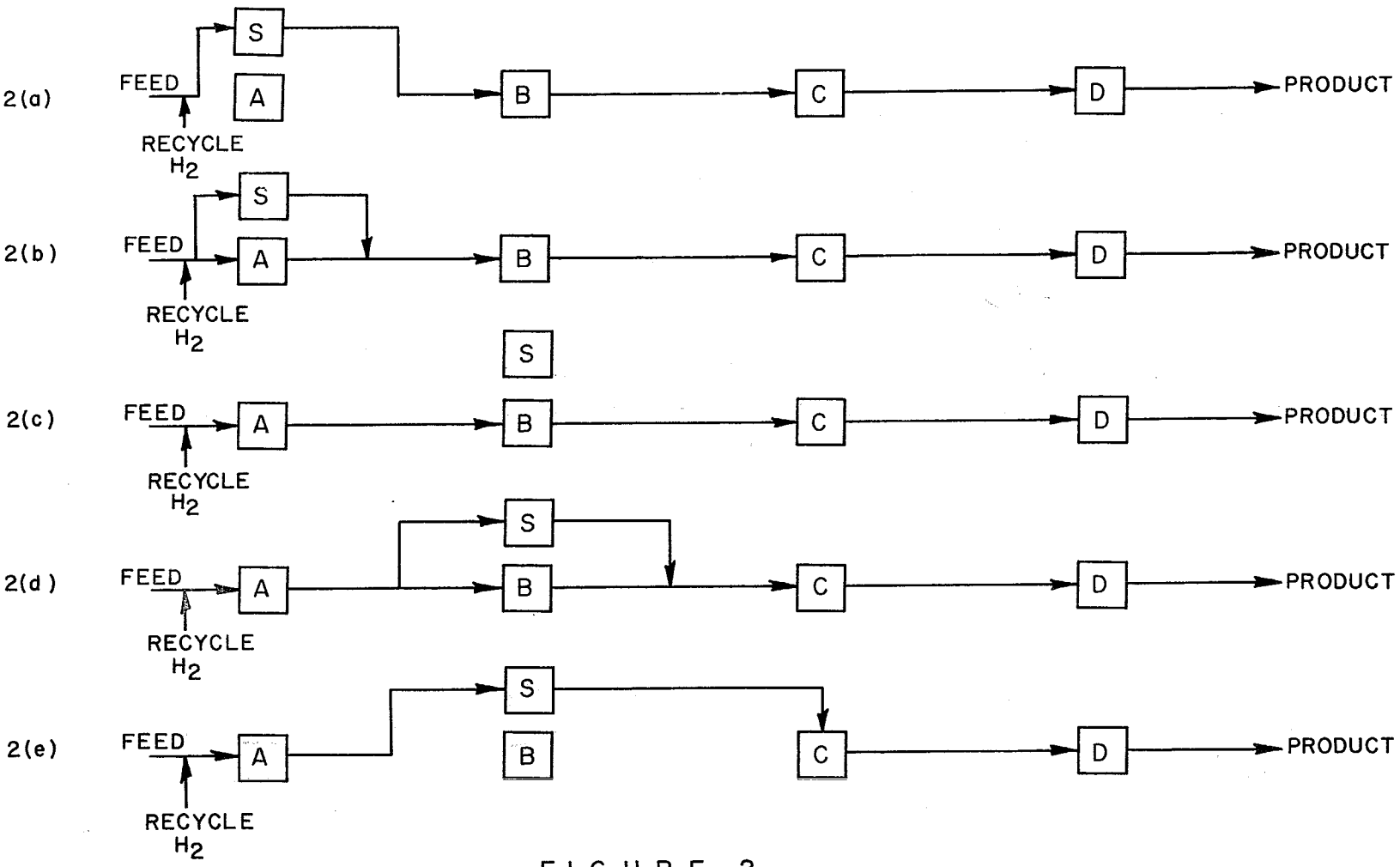
FIG. 2 depicts in schematic form a sequence of operation for scavenging sulfur from a cyclic unit utilizing the present inventive process.

This sequence of manipulations of the several reactors of the unit is more generally, and schematically, represented by reference to FIG. 2. FIG. 2*a* thus shows reactor A removed from the series and swing reactor S substituted for A, the catalyst of which is being regenerated, and reactivated. The flow of process fluid through the series of reactors can thus be represented SBCD, A being removed from the circuit for regeneration and reactivation of the catalyst. Reactor A, containing freshly reactivated catalyst in next swung back in line and is placed in parallel with swing reactor S as illustrated in FIG. 2(*b*). Reactor S is then cut out of the series and isolated as illustrated by reference to FIG. 3(*b*). Sulfur desorbed from the catalyst of reactor A is adsorbed by reactor B, next scheduled for regeneration and activation of the catalyst. On measurement of the inlet and outlet temperature of reactor B, as the sulfur is evolved and adsorbed by the near deactivated catalyst of reactor B, it is observed that the outlet temperature begins to approach the inlet temperature, and that the decline of $\Delta T$ ($T_{in}$-$T_{out}$) continues over a finite period until, upon reaching a minimum $\Delta T$, the outlet temperature changes direction and begins to decrease. At essentially the time the minimum $\Delta T$ is reached reactor S is paralleled with reactor B as shown by reference to FIG. 2(*d*). Reactor B is then cut out of series for reactivation and regeneration of the catalyst as shown by reference to FIG. 2(*e*), the net effect being that much of the sulfur is scavenged from the unit. Process fluid thus now flows through reactors A, S, C and D of the series.

It is found that from about 30 to about 90 percent, typically from about 50 to about 70 percent of the sulfur released by the upstream reactor can be adsorbed by the near deactivated catalyst of the scavenger reactor before significant desorption of sulfur from the catalyst of this reactor is begun. As desorption begins, the rate of sulfur evolution increases at first gradually, and then at an increasing rate. In most operations, it is preferred to swing the scavenger reactor out of series and insert the swing reactor at the beginning of sulfur desorption.

In conventional practice the reactor regeneration sequence is practiced in the order which will optimize the efficiency of the catalyst based on a consideration of the amount of coke deposited on the catalyst of the different reactors during the operation. In conventional practice coke deposits much more rapidly on the catalyst of reactors C, D and S than on the catalyst of reactors A and B and, accordingly, the catalysts of the former are regenerated and reactivated at greater frequency than the latter. The reactor regeneration sequence is characteristically in the order ACDS/BCDS, i.e., reactors A, C, D, B, etc., respectively, are substituted in order by another reactor, typically swing reactor S, and the catalyst thereof regenerated and reactivated while the other four reactors are left on stream. In the practice of the present invention, even when this sequence is followed, but with the exception that the reactor containing the near deactivated catalyst is left in series, with the upstream reactor containing the freshly regenerated reactivated catalyst for a sufficient time to trap the released sulfur, considerable benefit is obtained, and yet without any noticeable loss of efficiency caused by slightly delaying regeneration of this scavenger reactor. However, by altering the conventional sequence in an effort to obviate the adverse effects of excess sulfur within the system, even greater benefits can be obtained.

The invention, and its principle of operation, will be more fully understood by reference to the following examples, and comparative data. The examples and data presented below are mathematical expressions derived from pilot plant operations, operated at standard reforming conditions, from which the operation of a cyclic reforming unit can be quite readily simulated.

Referring to Table I there is tabulated, in a first series, mathematical computations for runs wherein the conventional reactor regeneration sequence ACDS/BCDS, supra, has been simulated, with sulfur from the reactors being trapped in the recycle drier. The first column of the table lists the reactors in the order taken off stream for catalyst regeneration; the second column lists the reactors which remain on stream during the regeneration of the catalyst of each of said reactors, respectively; the third column identifies the specific reactor which is releasing sulfur; the fourth column identifies the reactor which is trapping the sulfur; the fifth column lists the reactors which receive the full brunt of the sulfur liberated by the reactor containing the freshly regenerated, reactivated catalyst when it is put back on stream; and the sixth column lists the reactors which receive the full brunt of the sulfur liberated by the reactor containing the freshly regenerated, reactivated catalyst where the reactor to be regenerated first traps the released sulfur prior to being removed from the circuit. Comparing the fifth column with the sixth column reveals the improvement by using the C reactor once and the D reactor twice to trap liberated $H_2S$ from the immediate upstream reactor.

A second series of data is presented in Table I for the reactor regeneration sequence ACSD/BCSD a preferred series; and a third series of data is presented for the reactor regeneration sequence ABCSD, a more preferred sequence.

TABLE I

| Reactor Being Regen. | Reactors On Stream | Reactor Releasing Sulfur | Reactor Trapping Sulfur | Reactors Receiving Full Sulfur Pulses: Conventional | Reactors Receiving Full Sulfur Pulses: This Invention |
|---|---|---|---|---|---|
| ACDS/BCDS | | | | | |
| A | SBCD | S | — | BCD | BCD |
| C | ABSD | A | — | BSD | BSD |
| D | ABCS | C | D | S | — |
| S | ABCD | D | — | — | — |
| B | ASCD | S | — | CD | CD |
| C | ABSD | B | C | SD | — |
| D | ABCS | C | D | S | — |
| S | ABCD | D | — | — | — |
| ACSD/BCSD | | | | | |
| A | SBCD | D | — | — | — |
| C | ABSD | A | — | BSD | BSD |
| S | ABCD | C | — | D | D |
| D | ABCS | S | — | — | — |
| B | ASCD | D | — | — | — |
| C | ABSD | B | C | SD | — |
| S | ABCD | C | — | D | D |
| D | ABCS | S | — | — | — |
| ABCSD | | | | | |
| A | SBCD | D | — | — | — |
| B | ASCD | A | B | SCD | — |
| C | ABSD | B | C | SD | — |
| S | ABCD | C | — | D | D |
| D | ABCS | S | — | — | — |

Operated in this manner advantages can be shown for all three sequences of regeneration wherein this invention is employed. Through proper timing of reactor swings much of the sulfur is trapped on the near deactivated catalyst of a reactor next scheduled for catalyst regeneration and reactivation. Assume, for example, that a total operation requires 192 hours, and 24 hours are required for the regeneration of the catalyst of any given reactor. Assume further, that the catalyst of reactors C and D were regenerated and reactivated twice during this period, and that the catalysts of reactors A and B were regenerated and reactivated but once. Thus, reactors A and B were on stream for 168 hours of this period, and reactor C and D were on stream for two 72 hour periods. In reactor regeneration sequence ACDS/BCDS, ACSD/BCSD and ABCSD, respectively, the magnitude of the activity and $C_5+$ liquid yield debit can be directly correlated with the amount of sulfur exposure, or sulfur pulses to which the several reactors of the series are exposed during an operating period. In this regard the total number of reactor hours on oil, and the number of pulses of sulfur, between regenerations, to which the reactors of the series are exposed is pertinent. In this regard, in each of the reactor regeneration series ACDS/BCDS and ACSD/BCSD the reactors are on stream for a total of 552 hours between regenerations and in the reactor regeneration sequence ABCSD the reactors are on stream for a total of 480 hours. Thus, the pulses of sulfur that were transmitted during the period the reactors were on stream for a conventional operation and an operation pursuant to the present invention can be calculated, and a sulfur severity value assigned, as given in Table II which follows:

TABLE II

ACDS/BCDS

| Conventional Operation | | | This Invention | | |
|---|---|---|---|---|---|
| Pulses | Hours | Pulse-Hours | Pulses | Hours | Pulse-Hours |
| A-0 × | 168 | = 0 | A-0 X | 168 | = 0 |
| B-2 × | 168 | = 336 | B-2 × | 168 | = 336 |
| C-1 × | 72 | = 72 | C-1 × | 72 | = 72 |
| D-2 × | 72 | = 144 | D-1.5 × | 72 | = 108 |
| S-2 × | 72 | = 144 | S-0.5 × | 72 | = 36 |
| Severity factor 696/552 = 1.26 | | | Severity factor 552/552 = 1.0 | | |

ACSD/BCDS

| Conventional Operation | | | This Invention | | |
|---|---|---|---|---|---|
| Pulses | Pulse-Hours | Hours | Pulses | Pulse-Hours | Hours |
| A-0 × | 168 | = 0 | A-0 × | 168 | = 0 |
| B-1 × | 168 | = 168 | B-1 × | 168 | = 168 |
| C-0 × | 72 | = 0 | C-0 × | 168 | = 0 |
| D-2 × | 72 | = 144 | D-1.5 × | 72 | = 108 |
| S-1 × | 72 | = 72 | S-0.5 × | 72 | = 36 |
| Severity factor 384/552 = 0.696 | | | Severity factor 312/552 = 0.565 | | |

ABCSD

| Conventional Operation | | | This Invention | | |
|---|---|---|---|---|---|
| Pulses | Hours | Pulse-Hours | Pulses | Hours | Pulse-Hours |
| A-0 × | 96 | = 0 | A-0 × | 96 | = 0 |
| B-0 × | 96 | = 0 | B-0 × | 96 | = 0 |
| C-1 × | 96 | = 96 | C-0 × | 96 | = 0 |
| D-3 × | 96 | = 288 | D-1 × | 96 | = 96 |
| S-2 × | 96 | = 192 | S-0 × | 96 | = 0 |
| Severity factor 576/480 = 1.2 | | | Severity factor 96/480 = 0.2 | | |

Comparison of these values show the profound advantages offered by trapping liberated sulfur with a reactor containing a near deactivated catalyst immediately downstream of a reactor, containing freshly regenerated and reactivated catalyst, which is the source of released $H_2S$.

The above sulfur trapping techniques include $H_2S$ removal by the desiccant in the recycle gas drier, but sulfur trapping is also particularly beneficial in the case of $H_2S$ breakthrough in the drier. In this situation for conventional operation $H_2S$ returns to the reactors via the recycle gas and is only slowly purged from the system while it contacts all reactors on oil. Removal of the released presulfiding sulfur can be accelerated by applying this invention, thereby preventing long term exposure of the catalyst to sulfur accompanied by activity and yield losses during the cycle.

It is apparent that the present invention is subject to various modifications and changes without departing the spirit and scope thereof.

The present invention finds its greatest utility in cyclic reforming processes wherein the new "bimetallic" or multimetallic catalysts are employed, notably Group VIII platinum group, or noble metals (ruthenium, rhodium, palladium, osmium, iridium and platinum), e.g., platinum-rhenium, platinum-rhenium-iridium, palladium-rhenium, platinum-palladium-rhenium, etc. Fresh, or reactivated catalyst of this type are particularly hypersensitive. Exotherms or heat fronts can be produced which pass through a catalyst bed at startup, i.e., when new or freshly regenerated catalyst is initially contacted with hydrocarbons at reforming temperatures. The temperature excursions or heat fronts are attributed to the hyperactivity of the catalyst which causes excessive hydrocracking of the hydrocarbons or hydrogenolysis, sometimes referred to as "runaway hydrocracking." These temperature excursions or heat fronts are undesirable because the resultant temperature often results in damage to the catalyst, or causes excessive coke laydown on the catalyst with consequent catalyst deactivation and, if uncontrolled, may even lead to damage to the reactor and reactor internals.

Other catalysts suitable for the practice of this invention contain a hydrogenation-dehydrogenation component constituted of a platinum group metal, or admixtures of these and/or one or more additional non-platinum group metallic components such as germanium, gallium, tin, rhenium, tungsten, and the like. A preferred type of catalyst contains the hydrogenation-dehydrogenation component in concentration ranging from about 0.01 to about 5 wt. %, and preferably from about 0.2 to about 1.0 wt. %, based on the total catalyst composition. In addition, such catalysts also usually contain an acid component, preferably halogen, particularly chlorine or fluorine, in concentration ranging from about 0.1 to about 5 wt. %, and preferably from about 0.3 to about 1.0 wt. %. The hydrogenation-dehydrogenation components are composited with an inorganic oxide support, such as silica, silica-alumina, magnesia, thoria, zirconia, or the like, and preferably alumina.

Methods of regeneration, and reactivation of these catalysts are known and per se form no part of the present invention. Conventionally, an isolated reactor which contains a bed of catalyst, the latter having reached an objectionable degree of deactivation due to coke deposition thereon, is first purged of hydrocarbon vapors with a nonreactive or inert gas, e.g., helium, nitrogen, or flue gas. The coke or carbonaceous deposits are then burned from the catalyst by contact with an oxygen-containing gas at controlled temperature below the sintering point of the catalyst, generally below about 1300° F., and preferably below about 1200° F. The temperature of the burn is controlled by controlling the oxygen concentration and inlet gas temperature, this taking into consideration, of course, the amount of coke to be burned and the time desired in order to complete the burn. Typically, the catalyst is treated with a gas having an oxygen partial pressure of at least about 0.1 psi (pounds per square inch), and preferably in the range of about 0.3 psi to about 2.0 psi to provide a temperature ranging from 575° F. to about 1000° F., at static or dynamic conditions, preferably the latter, for a time sufficient to remove the coke deposits. Coke burn-off can be accomplished by first introducing only enough oxygen to initiate the burn while maintaining a temperature on the low side of this range, and gradually increasing the temperature as the flame front is advanced by additional oxygen injection until the temperature has reached optimum. Most of the coke can be readily removed in this way.

Typically in reactivating multimetallic catalysts, sequential halogenation and hydrogen reduction treatments are required to reactivate the reforming catalysts to their original state of activity, or activity approaching that of fresh catalyst after coke or carbonaceous deposits have been removed from the catalyst. Suitably, the coke is burned from the catalyst, initially by contact thereof with an admixture of air and about 0.75 wt. percent oxygen at temperatures ranging to about 750° F., and thereafter the oxygen is increased within the mixture to about 6 wt. percent and the temperature gradually elevated to about 950° F.

The agglomerated metals of the catalyst are redispersed and the catalyst reactivated by contact of the catalyst with halogen, suitably a halogen gas or a substance which will decompose in situ to generate halogen. Various procedures are available dependent to a large extent on the nature of the catalyst employed. Typically, e.g., in the reactivation of a platinum-rhenium catalyst, the halogenation step is carried out by injecting halogen, e.g., chlorine, bromine, fluorine or iodine, or a halogen component which will decompose in situ and liberate halogen, e.g., carbon tetrachloride, in the desired quantities, into the reaction zone. The gas is generally introduced as halogen, or halogen-containing gaseous mixture, into the reforming zone and into contact with the catalyst at temperature ranging from about 550° F. to about 1150° F., and preferably from about 700° F. to about 1000° F. The introduction may be continued up to the point of halogen breakthrough, or point in time when halogen is emitted from the bed downstream of the location of entry where the halogen gas is introduced. The concentration of halogen is not critical, and can range, e.g., from a few parts per million (ppm) to essentially pure halogen gas. Suitably, the halogen, e.g., chlorine, is introduced in a gaseous mixture whrein the halogen is contained in concentration ranging from about 0.01 mole percent to about 10 mole percent, and preferably from about 0.1 mole percent to about 3 mole percent.

After redispersing the metals with the halogen treatment, the catalyst can then be rejuvenated by soaking in an admixture of air which contains about 6 wt. percent oxygen, at temperatures ranging from about 850° F. to about 950° F.

Oxygen is then purged from the reaction zone by introduction of a nonreactive or inert gas, e.g., nitrogen, helium or flue gas, to eliminate the hazard of a chance explosive combination of hydrogen and oxygen. A reducing gas, preferably hydrogen or a hydrogen-containing gas generated in situ or ex situ, is then introduced into the reaction zone and contacted with the catalyst at temperatures ranging from about 400° F. to about 1100° F., and preferably from about 650° F. to about 950° F., to effect reduction of the metal hydrogenation-dehydrogenation components, contained on the catalysts. Pressures are not critical, but typically range between about 5 psig to about 300 psig. Suitably, the gas employed comprises from about 0.5 to about 50 percent hydrogen, with the balance of the gas being substantially nonreactive or inert. Pure, or essentially pure, hydrogen is, of course, suitable but is quite expensive and therefore need not be used. The concentration of the hydrogen in the treating gas and the necessary duration of such treatment, and temperature of treatment, are interrelated, but generally the time of treating the catalyst with a gaseous mixture such as described ranges from about 0.1 hour to about 48 hours, and preferably from about 0.5 hour to about 24 hours, at the more preferred temperatures.

The catalyst of a reactor is next presulfided, prior to return of the reactor to service. Suitably a carrier gas, e.g., nitrogen, hydrogen, or admixture thereof, containing from about 500 to about 2000 ppm of hydrogen sulfide, or compound, e.g., a mercaptan, which will decompose in situ to form hydrogen sulfide, at from about 700° F. to about 950° F., is contacted with the catalyst for a time sufficient to incorporate from about 0.01 to about 0.1 percent sulfur within the catalyst, based on the weight of the catalyst.

Having described the invention what is claimed is:

1. In a process for reforming a naphtha in a cyclic reforming unit which contains a plurality of catalyst-containing on stream reactors connected in series, and a catalyst-containing swing reactor which, due to an arrangement of process piping and valves comprising headers, can be substituted for any one of the on stream reactors while the latter is off stream for regeneration and reactivation of the catalyst, the naphtha feed flowing from one reactor of the series to another to contact the catalyst contained therein at reforming conditions, the improvement comprising maintaining on stream, after return to service of an upstream reactor which contains freshly regenerated and reactivated catalyst, a reactor immediately downstream of and next in series with said upstream reactor which contains a near deactivated catalyst which is next to be regenerated and reactivated, such that on the introduction of naphtha into contact with the regenerated, reactivated catalyst of said immediate upstream reactor at reforming conditions sulfur is desorbed from the catalyst, continuing to maintain said downstream reactor which contains the near deactivated catalyst on stream while the sulfur that is released by the catalyst of said upstream reactor is adsorbed on said near deactivated catalyst, connecting the swing reactor in parallel with said reactor which contains the near deactivated catalyst on which sulfur is being adsorbed, and then disconnecting and removing from series said reactor containing the near deactivated catalyst prior to the desorption and release of major amounts of sulfur from the catalyst of said reactor.

2. The process of claim 1 wherein a series of four on stream reactors are identified, for convenience, as A, B, C, D, respectively, and the swing reactor is identified, for convenience as S, the improvement wherein the catalysts of the reactors are regenerated and reactivated in the reactor sequence ACDS/BCDS.

3. The process of claim 2 wherein the catalysts of the reactors are regenerated and reactivated in the reactor sequence ACSD/BCSD.

4. The process of claim 2 wherein the catalysts of the reactors are regenerated and reactivated in the reactor sequence ABCSD.

5. The process of claim 1 wherein the reactor of the sequence immediately downstream of that which contains the freshly regenerated, reactivated catalyst, and further identified as the reactor containing a near deactivated catalyst, is maintained on stream until such time as the differential between the reactor outlet temperature and the inlet temperature has reached a minimum and begins to increase again as sulfur begins to desorb from the near deactivated catalyst of said reactor; at which time the reactor is then removed from the series and replaced by the swing reactor.

6. The process of claim 5 wherein from about 30 to about 90% of the released sulfur is adsorbed by the near deactivated catalyst of said downstream reactor prior to the time that it is removed from the series and replaced by the swing reactor.

7. The process of claim 6 wherein from about 50 to about 70 percent of said sulfur is adsorbed by the near deactivated catalyst of said downstream reactor.

8. The process of claim 1 wherein the catalysts are platinum catalysts promoted with a hydrogenation-dehydrogenation component, or components, which increase the rate of hydrogenolysis as contrasted with an unpromoted platinum catalyst.

9. The process of claim 8 wherein the platinum catalyst is promoted with rhenium.

* * * * *